US007591658B2

(12) United States Patent
Chen

(10) Patent No.: US 7,591,658 B2
(45) Date of Patent: Sep. 22, 2009

(54) LIGHT STRING WITH IMPROVED SHUNT SYSTEM

(75) Inventor: Qi Chen, Guangdong (CN)

(73) Assignee: NCP Corporation, Cranford, NJ (US)

( * ) Notice: Subject to any disclaimer, the term of this patent is extended or adjusted under 35 U.S.C. 154(b) by 0 days.

(21) Appl. No.: 11/977,621

(22) Filed: Oct. 25, 2007

(65) Prior Publication Data

US 2008/0108251 A1 May 8, 2008

(30) Foreign Application Priority Data

Dec. 25, 2006 (CN) ..... 2006 2 0015418

(51) Int. Cl.
*H01R 29/00* (2006.01)

(52) U.S. Cl. ..... 439/188

(58) Field of Classification Search ..... 439/375, 439/699.2, 188, 189; 200/51.1; 362/288, 362/655

See application file for complete search history.

(56) References Cited

U.S. PATENT DOCUMENTS

| | | | | |
|---|---|---|---|---|
| 932,139 | A | 8/1909 | Kempton | |
| 1,536,332 | A | 5/1925 | Dam | |
| 2,984,813 | A | 5/1961 | Bossi | |
| 3,286,088 | A | 11/1966 | Ahroni | |
| 3,522,579 | A | 8/1970 | Matsuya | |
| 4,720,272 | A | 1/1988 | Durand | |
| 5,139,343 | A | 8/1992 | Lin | |
| 5,281,158 | A * | 1/1994 | Lin | 439/188 |
| 5,453,664 | A | 9/1995 | Harris | |
| 5,791,940 | A | 8/1998 | Chen et al. | |
| 5,807,134 | A | 9/1998 | Hara | |
| 5,816,862 | A | 10/1998 | Tseng | |
| 5,839,819 | A | 11/1998 | Pan | |
| 5,860,830 | A | 1/1999 | Wu | |
| 6,257,740 | B1 | 7/2001 | Gibboney, Jr. | |
| 6,533,437 | B1 * | 3/2003 | Ahroni | 362/249.14 |
| 6,783,383 | B1 | 8/2004 | Gibboney | |
| 6,929,383 | B1 | 8/2005 | Janning | |
| 2007/0297196 | A1 | 12/2007 | Massabki et al. | |

* cited by examiner

*Primary Examiner*—Javaid Nasri
(74) *Attorney, Agent, or Firm*—Brian K. Johnson, Esq., LLC

(57) ABSTRACT

The present invention relates to a lamp holder having two terminals arranged at the end of two wires of a light string and a light bulb preassembled in a lamp base. Electrodes from the lamp and base make contact with the terminals as the lamp is inserted into the inside of the lamp holder. A bulge is arranged at on position within the lamp base. An electrically conductive spring is arranged in the inside of the lamp holder having two feet corresponding to the positions of the terminals. Each foot is in contact with one of the terminals when the bulb and base are out of the holder, but one foot is displaced by the bulge on the lamp base to provide electrical connection through the lamp rather than the spring when the lamp is inserted into the holder.

3 Claims, 2 Drawing Sheets

LIGHT STRING WITH IMPROVED SHUNT SYSTEM

CROSS-REFERENCES TO RELATED APPLICATIONS

This application claims priority under 35 USC §119 from Chinese patent application Serial No. 200620015418.0, filed on Oct. 25, 2006, entitled DECORATIVE LIGHT, the disclosure and application of which is incorporated by reference herein in its entirety.

TECHNICAL FIELD

The present utility model relates to a decorative light, and more particularly to a decorative light which keeps the circuit connected when one or several light bulbs fall off from the series-connected light bulbs of a light string (customarily it is called as a holiday decorative light.).

TECHNICAL BACKGROUND

In the prior arts, small light bulbs connected in series with a low voltage are lightened synchronously. The entire circuit is disconnected when one or more tungsten filaments are burn out or when one or more light bulbs fall off.

In order to resolve this problem, the Chinese Patent #CN95226975.9 discloses a light bulb with resistance wire, a circuit is established by the resistance wire when one or several tungsten filaments are burn out, which does not affect the other light bulbs. However, the resistance wire or fuse as disclosed in the Chinese patent #CN95226975.9 is arranged inside of the light bulb, a decorative light with the light bulbs is turned off when one or several light bulbs fall off, which results in the decorative light not working.

SUMMARY OF THE INVENTION

It is an object of the present utility model to provide a decorative light which keeps working when one or several light bulbs fall off to overcome the disadvantages of the above described prior arts, The object of the present utility model is achieved by the following means:

The decorative light of the present utility model comprises a pipe-shaped lamp holder, a light bulb preassembled with a lamp base, two terminals arranged at the end of two wires. The lamp base and the terminals are respectively inserted into the inside of the lamp holder from two different ends of the lamp holder. The two electrodes of the light bulb are respectively connected to the two terminals. The decorative light is characterized in that a bulge is arranged at the end of the lamp base facing to the terminals and the bulge is close to one of the two terminals; a torsion spring made with conductive material is arranged in the inside of the lamp holder; the torsion spring is provided with two feet corresponding to the positions of the terminals, one foot is contacted with one of the terminals, and the other foot has spacing with the other one of the terminals due to the pressure from the bulge on the lamp base; the two feet of the torsion spring are respectively contacted with their corresponding terminals by means of a torsion force from the torsion spring when the lamp base falls off from the lamp holder.

The torsion spring has a pipe shape with wound steel wire, and has a hollow passage.

An end plug is provided in the inside of the lamp holder and the end plug is arranged between the two terminals. A post is set at the end plug and the post is fitted into the hollow passage of the pipe-shaped torsion spring.

As compared with the prior arts, a light string formed with the decorative light of the present utility model keeps alit when one or several assembled bulbs and lamp bases fall off, which is because the torsion spring makes the circuit connected immediately by means of a torsion force.

DETAILED DESCRIPTION OF THE INVENTION

A detailed description of the present utility model will be shown below with reference to the figures.

Figure 1:
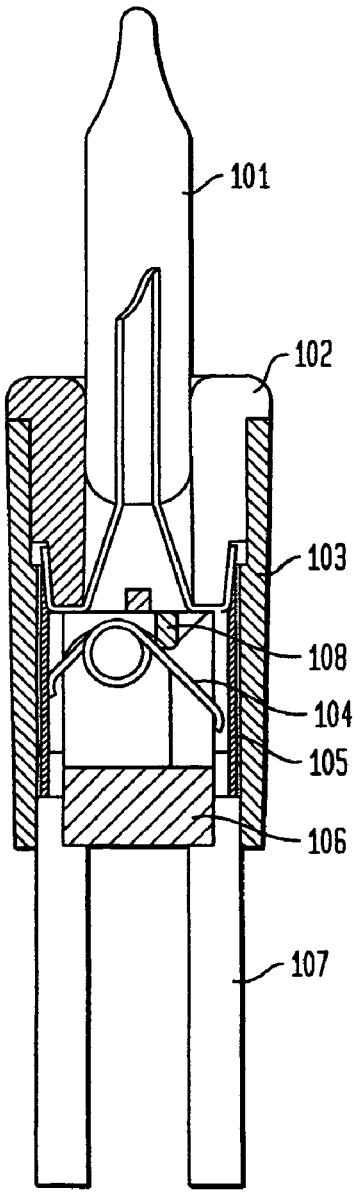
FIG. 1 is an assembly diagram according to an embodiment of the present utility model.
Figure 2:
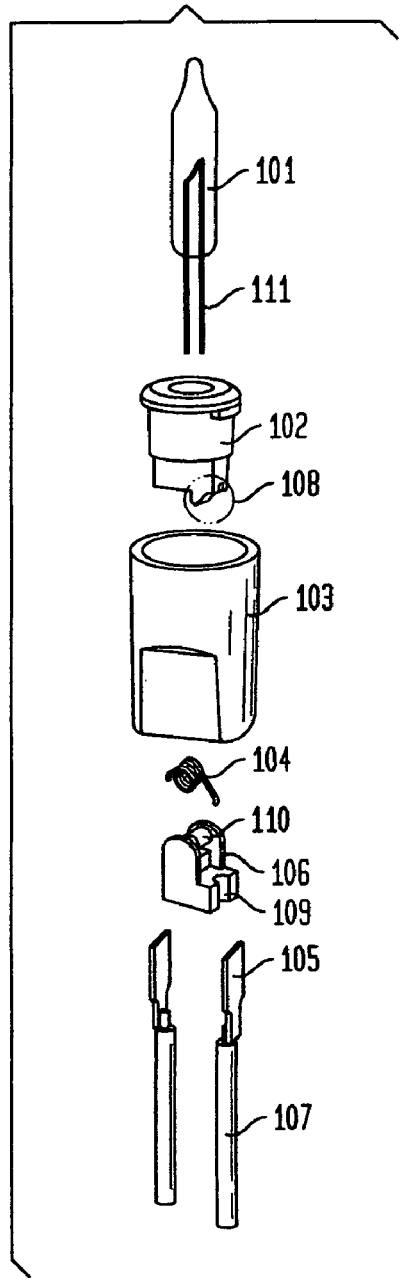
FIG. 2 is a disassembly diagram according to an embodiment of the present utility model.

FIG. 1 and FIG. 2 show an embodiment of the present utility model. Bulb 101 and lamp base 102 are preassembled together, and then an assembled body of the bulb 101 and the lamp base 102 is inserted into one end of the lamp holder 103. The copper terminals 105 are pressed into the ends of the wires 107; there are two wires 107 as well as two copper terminals 105 provided; the copper terminals 105 are inserted in the other end of the lamp holder 103. As shown in FIG. 1, the two copper terminals 105 are respectively connected to the two electrodes 111 of bulb 101. There is a bulge 108 at the end of the lamp base 102 facing to the copper terminals 105. The bulge is close to one of the two terminals 105. A torsion spring 104 made with steel wire is arranged in the lamp holder 103. The torsion spring 104 is provided with two feet corresponding to the positions of the copper terminals 105, one foot is in contact with one of the terminals 105, and the other foot is spaced apart from the other of the terminals 105 due to the presence of the bulge 108 on the lamp base. The two feet of the torsion spring are respectively connected to their corresponding terminals to establish a circuit by means of the torsion force from the torsion spring when the assembled body of the lamp base 102 and the bulb 101 falls off from the lamp holder 103. The torsion spring 104 of the present utility model has a pipe shape with wound steel wire, and has a hollow passage. An end plug 106 containing a recessed volume 109 is provided in the lamp holder 103 and the end plug is arranged between the two terminals 105. A post 110 is set at the end plug 106 and the post is fitted into the hollow passage of the pipe-shaped torsion spring 104. The torsion spring 104 makes the circuit connected by means of a torsion force when one or several assembled bulbs and the lamp bases fall off.

Figure 3:
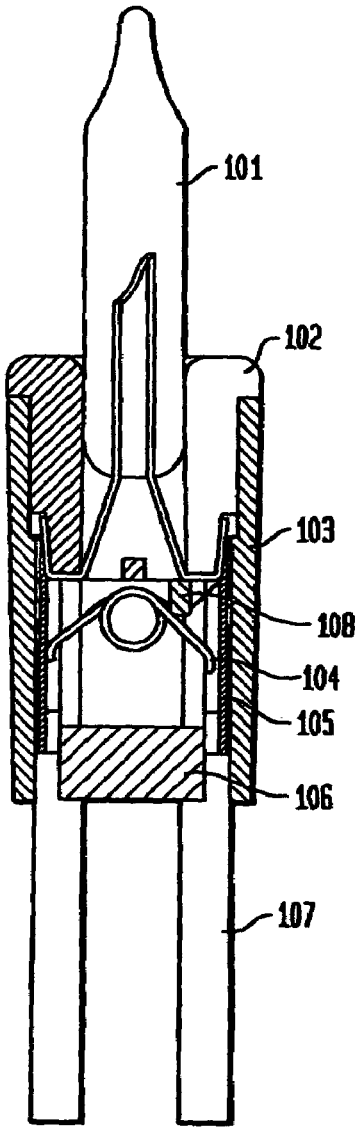
FIG. 3 is an assembly diagram according to another embodiment of the present utility model.
Figure 4:
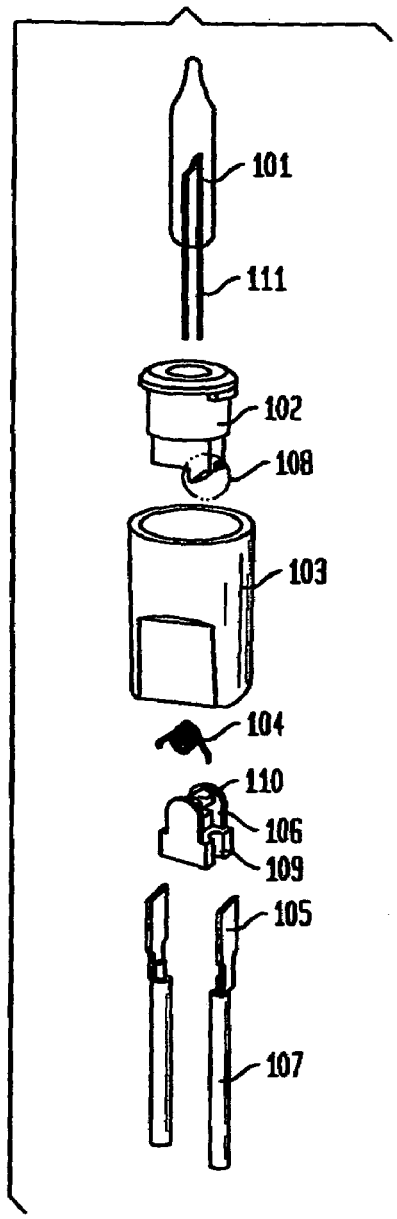
FIG. 4 is a disassembly diagram according to another embodiment of the present utility model.

FIG. 3 and FIG. 4 show an alternative embodiment of the present utility model. The features of these embodiments corresponds closely with those in figure 1 and 2 and like designation numbers designate like features. Additional features in figure 3 and 4 includes a second recessed volume 109 on the backside of end plug 106, central disposition of torsion spring 104, now with substantially equal length legs, on post 110 as affixed to end plug 106, This arrangement provides for insertion of lamp base 102 into lamp holder 103 in one of two orientations, so that bulge 108 may disengage either of the two legs of torsion spring 104 to provide for electrical connection through the bulb 101.

The decorative light of the present utility model is generally used with a plurality of decorative lights connected in series to form a string light. In order to avoid a power short circuit caused by the falling-off of all light bulbs from the string light, at least one light of the string light should not be the decorative light of the present embodiment. Alternatively, a decorative light with a fuse can be used or a decorative light of the present embodiment can be used in the string light after a torsion spring is removed.

The present utility model provides a decorative light which keeps working when one or several assembled light bulbs and lamp bases fall off.

What is claimed is:

1. A decorative lighting system, comprising a pipe-shaped lamp holder, a light bulb preassembled with a lamp base, and two terminals arranged at an end of each of two wires, wherein the lamp base and the terminals are respectively inserted into the inside of the lamp holder from two different ends of the lamp holder, and two electrodes of the light bulb are respectively connected to the two terminals, characterized in that a bulge is arranged at the end of the lamp base facing to the terminals and the bulge is close to one of the two terminals; a torsion spring made with conductive material is arranged inside of the lamp holder; the torsion spring is provided with two feet corresponding to positions of the terminals, a first foot is in contact with one of the terminals, and a second foot is spaced apart from the other one of the terminals due to the pressure from the bulge on the lamp base; the two feet of the torsion spring are respectively contacted with their corresponding terminals by means of a torsion force from the torsion spring when the lamp base is removed from the lamp holder, the torsion spring has a pipe shape with wound steel wire, and has a hollow passage and an end plug is provided in the inside of the lamp holder and the end plug is arranged between the two terminals; a post is set at the end plug and the post is fitted into the hollow passage of the torsion spring.

2. A lamp holder for providing electrical connection between two light string terminals; said lamp holder comprising:

an end plug having a post and a recessed volume;

a spring mounted on said post; said spring having two feet; one foot of said spring being in fixed contact with one of said light string terminals; the other foot of said spring being in contact with the other of said light string terminals when no light bulb is present in said holder so that as to electrically connect the two light string terminals through said spring; the other foot of said spring being displaced into said recessed volume and disengaged from said other of said light string terminals when a light bulb is present in said holder so as to electrically connect the two light string terminals through said light bulb.

3. The lamp holder of claim 2 wherein said end plug contains another recessed volume such that either one of said two spring feet are disengageable from their respective light string terminals when a light bulb is present in said holder.

* * * * *